US012408783B2

(12) United States Patent
Lebold et al.

(10) Patent No.: US 12,408,783 B2
(45) Date of Patent: Sep. 9, 2025

(54) NEEDLEFELT PORTABLE SUPPORT PAD

(71) Applicant: Andrew Industries Ltd., Altham (GB)

(72) Inventors: Alan Robert Lebold, Niagara Falls, NY (US); Justin William Popek, Spencerport, NY (US); Jake Edward Schoelles, Buffalo, NY (US)

(73) Assignee: ANDREW INDUSTRIES LTD., Altham (GB)

( * ) Notice: Subject to any disclaimer, the term of this patent is extended or adjusted under 35 U.S.C. 154(b) by 45 days.

(21) Appl. No.: 18/629,079

(22) Filed: Apr. 8, 2024

(65) Prior Publication Data

US 2024/0389778 A1 Nov. 28, 2024

Related U.S. Application Data

(63) Continuation of application No. PCT/US2024/021302, filed on Mar. 25, 2024.

(60) Provisional application No. 63/468,345, filed on May 23, 2023.

(51) Int. Cl.
*A47G 27/02* (2006.01)

(52) U.S. Cl.
CPC ..... *A47G 27/0231* (2013.01); *A47G 27/0237* (2013.01)

(58) Field of Classification Search
CPC ..... A47G 27/0218; A47G 27/0225; A47G 27/0231; A47G 27/0237; A47G 27/0412; B32B 5/022; B32B 5/073; B32B 5/08; B32B 5/09; D04H 1/04; D04H 1/40; D04H 13/005
See application file for complete search history.

(56) References Cited

U.S. PATENT DOCUMENTS

| | | | | |
|---|---|---|---|---|
| 2,061,664 | A | 11/1936 | Lincoln | |
| 3,323,151 | A | 6/1967 | Lerman | |
| 3,434,715 | A | 3/1969 | Brantingham et al. | |
| 4,522,876 | A * | 6/1985 | Hiers | B32B 5/06 55/DIG. 35 |
| 8,677,532 | B2 | 3/2014 | Legare | |
| D924,598 | S | 7/2021 | Cohen | |
| D951,677 | S | 5/2022 | Cohen | |
| 2006/0141884 | A1 * | 6/2006 | Haque | B32B 5/06 442/361 |
| 2007/0079919 | A1 * | 4/2007 | Haskett | B32B 5/08 264/122 |
| 2010/0052229 | A1 | 3/2010 | Baur, IV | |
| 2011/0041249 | A1 | 2/2011 | Harrison | |
| 2016/0345686 | A1 * | 12/2016 | Clarner | B32B 5/08 |
| 2018/0363183 | A1 * | 12/2018 | Jarrard | D04H 3/10 |
| 2019/0117040 | A1 * | 4/2019 | Knight | B32B 3/06 |
| 2022/0134703 | A1 * | 5/2022 | Brandt | A43B 1/02 428/196 |

* cited by examiner

*Primary Examiner* — George Sun
(74) *Attorney, Agent, or Firm* — MATTINGLY & MALUR, PC

(57) ABSTRACT

Some examples include a portable support pad constructed of nonwoven needlefelt, such as for relieving physical stress and fatigue endured from extended kneeling, sitting, lying and/or standing on rigid, flat, irregular, and/or un-even surfaces. The support pad constructed of the nonwoven needlefelt is flexible porous, absorptive, and chemically resistant to corrosive substances.

19 Claims, 12 Drawing Sheets

NEEDLEFELT PORTABLE SUPPORT PAD

CROSS-REFERENCES TO RELATED APPLICATIONS

This application is a continuation of, and claims priority to, PCT/US24/021302, filed Mar. 25, 2024, which claims the benefit of U.S. Provisional Patent Application No. 63/468,345, filed May 23, 2023, and all of which are incorporated by reference herein.

BACKGROUND

Standing, sitting, lying, or kneeling on rigid surfaces can cause physical stress, fatigue, or discomfort if sustained for long periods of time. To avoid or lessen the physical stress associated with this, it is often helpful to use a portable support pad (also referred to as a "portable support mat", "kneeling pad", or the like) to cover and provide cushioning over the rigid surface that the user would otherwise come in contact with. Such portable support pads are often used in working settings ranging from construction/hazardous work to gardening or other leisure activities. Conventional portable support pads may often be provided with a smooth surface finish to aid in the maintenance and surface cleaning of the portable support pad. These portable support pads generally cannot absorb liquid or be washed using a conventional laundry machine. A common material choice for conventional portable support pads is high-density foam, which provides thick cushioning but is rather inflexible, rendering the portable support pad less effective for use on non-flat surfaces, and less able to be stored or transported compactly. Further, existing solutions that employ high density foam are typically susceptible to corrosive substances and materials, which may limit possible use cases.

SUMMARY

Some implementations include a portable support pad for reducing physical stress and/or fatigue associated with kneeling, sitting, lying, and/or standing on rigid, flat, irregular and/or un-even surfaces. The portable support pad may be constructed of nonwoven needlefelt. For example, the portable support pad may be constructed of nonwoven needlefelt material that includes between 50% to 100% 1.0 denier to 6.0 denier fiber as a lower denier fiber, and 0% to 50% 3.0 denier to 15.0 denier fiber as a higher denier fiber.

BRIEF DESCRIPTION OF THE DRAWINGS

The detailed description is set forth with reference to the accompanying figures. In the figures, the use of the same reference numbers in different figures indicates similar or identical items or features.

Figure 1:
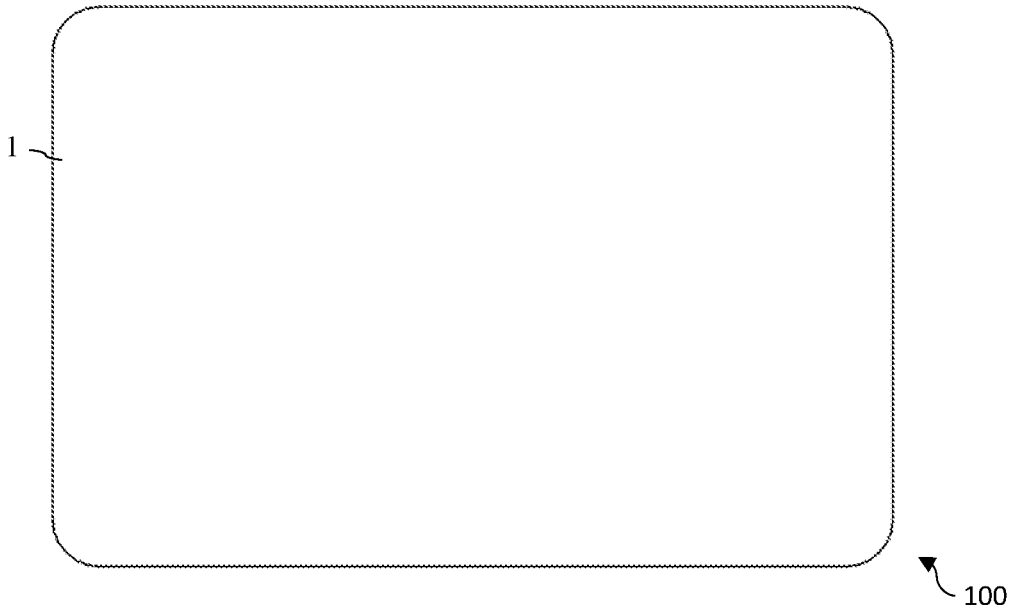
FIG. 1 depicts a top view of an example die cut needlefelt portable support pad according to some implementations.

The description and drawings are only for purpose of illustration and helping to understand and are not intended to define the limits/total design or application of the implementations herein.

DETAILED DESCRIPTION

Some implementations herein include a portable support pad constructed of a nonwoven needlefelt that addresses the deficiencies identified in current support pad solutions related to in-flexibility on non-flat surfaces, chemical vulnerability, low absorption capability, and the requirement of manual wash and dry. The nonwoven portable support pad material may be either single material polyester needlefelt or a needlefelt laminated to a film. The needlefelt may be constructed of varying fiber denier wherein denier is an industry standardized unit of measurement for the size (linear mass density) of a fiber specifically measured in units of grams per 9000 meters of length. The needlefelt fibers may be of varying chemistry or composition and they may contain chemical coatings. The needlefelt material may be of varying area weights, wherein area weight is an industry standardized measurement of mass per unit area commonly grams per square meter (gsm) and varying thicknesses to fit the specific application. The needlefelt material is comprised of multiple layers or batts of lofty webbing structure which is consolidated into the final desired area weight and thickness. Each batt can be unique in design and may contain any of the aforementioned variations.

The portable support pad in some examples may be affixed with a handle or have a section of the area removed to create an opening to serve as a handle. The shape of the perimeter of the portable support pad may be rectangular, oval, circular, rounded, any combination thereof, or any other desired shape, and may be of any of various sizes so as to be suitable for different applications. The finish on either of the supporting surfaces and/or the perimeter sides of the portable support pad may be loom-state (e.g., unfinished), may be rough-textured by applying a singe treatment by which the surface is exposed to a heat source at some distance causing a portion of fibers to melt together and harden on the surface. In other examples, the surface may be glazed wherein the surface is partially melted and smoothened through exposure to heat and pressured rollers during a finishing process beyond initial manufacturing. The polyester fibers used to construct the portable support pad can be treated with chemicals for performance benefits such as flame resistance, hydrophilic behavior, or hydrophobic behavior. Additionally, dyes can be applied to the fibers of the polyester used to construct the portable support pad, such as to change the color of the portable support pad as desired. For aesthetic or informative purposes, the pad may be embossed with brand emblems, words, designs, graphics, or the like. Some examples herein may provide a highly flexible and cushioning support pad applicable to all surfaces (including non-flat surfaces) that is chemically resistant, able to absorb excess liquids/substances incurred during use, and able to be periodically washed or otherwise reconditioned by conventional in-home or commercial laundry machine washing and drying.

FIGS. 1-4 illustrate an example die cut polyester needlefelt portable support pad 100 according to some implementations. The portable support pad 100 may be used to help to relieve the physical stress and fatigue endured in many activities and applications that require prolonged standing, kneeling, sitting, or lying on rigid, abrasive, uneven, rough, and/or sharp surfaces.

Figure 2:
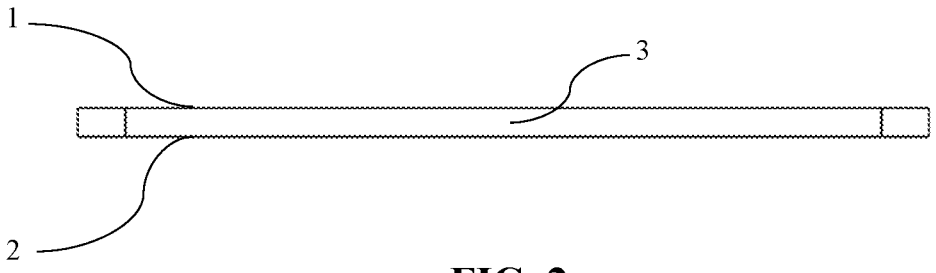
FIG. 2 depicts a front view of the portable support pad of FIG. 1.
Figure 3:
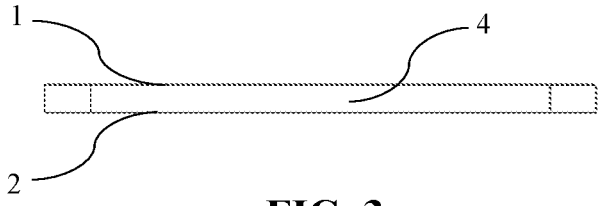
FIG. 3 depicts a side view of the portable support pad of FIG. 1.
Figure 4:
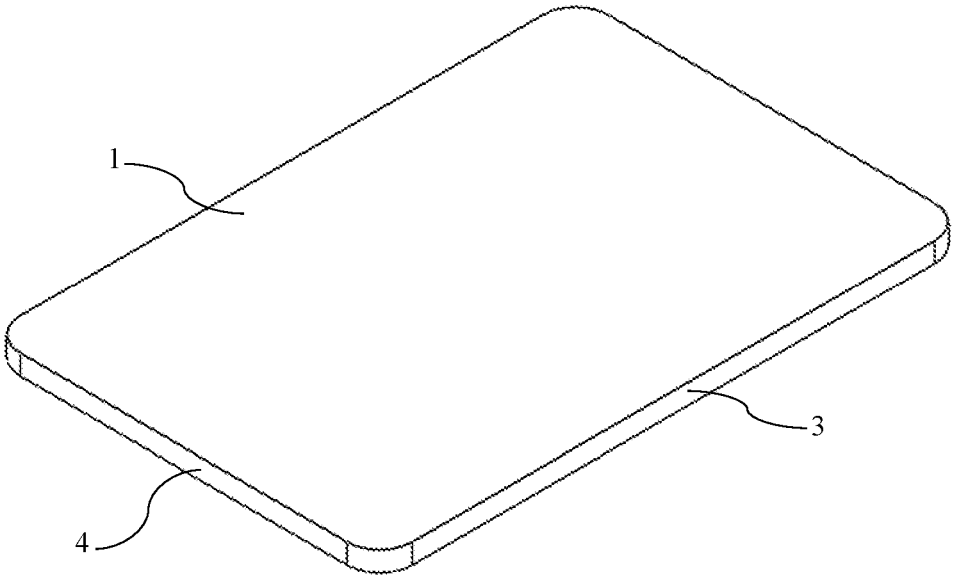
FIG. 4 depicts an isometric view of the portable support pad of FIG. 1.

The portable support pad 100 in this example may be generally flat and of a generally constant thickness. An upper support surface 1 and a lower support surface 2 may be generally flat and parallel to each other as shown in FIGS. 1 and 2. Additionally, in this example, the portable support pad 100 further includes a pair of opposed longer-side edge surfaces 3 as shown in FIGS. 2 and 4, and a pair of opposed shorter-side edge surfaces 4 as shown in FIGS. 3 and 4. Both surfaces 1 and 2 as shown in FIGS. 1 to 4 are of the same size and shape and, in this example, are generally of rectangular shape with rounded corners. Of course, in other examples, the portable support pad 100 may have any desired alternative shape, such as already discussed above. In addition to shape and size, the upper support surface 1 and the lower support surface 2 as shown in FIGS. 1 to 4 may have the same texture and/or finish so that the portable support pad can be used with either side 1 or 2 facing upward or downward. Alternatively, in other examples, the upper support surface 1 may have a first surface treatment, and the lower support surface 2 may have a different surface treatment or no surface treatment. Additional details of the composition and construction of the portable support pad are discussed below.

Figure 5:
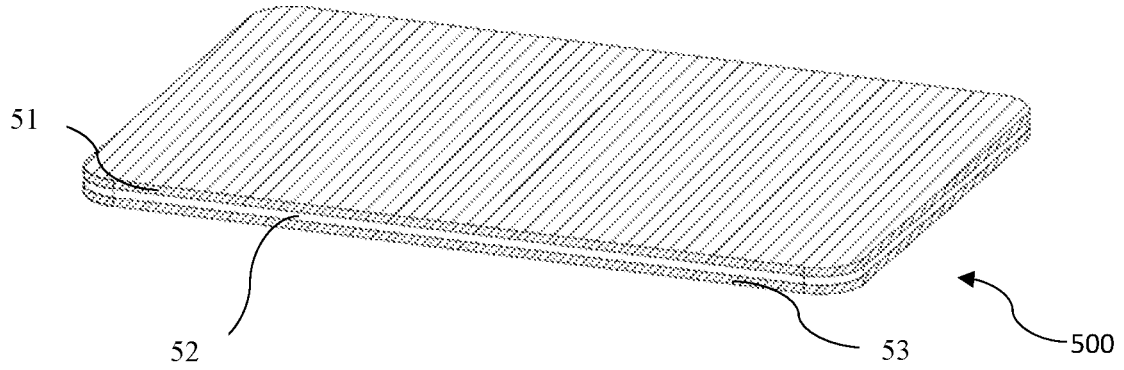
FIG. 5 depicts an isometric view of the portable support pad having a composite structure according to some implementations.
Figure 6:
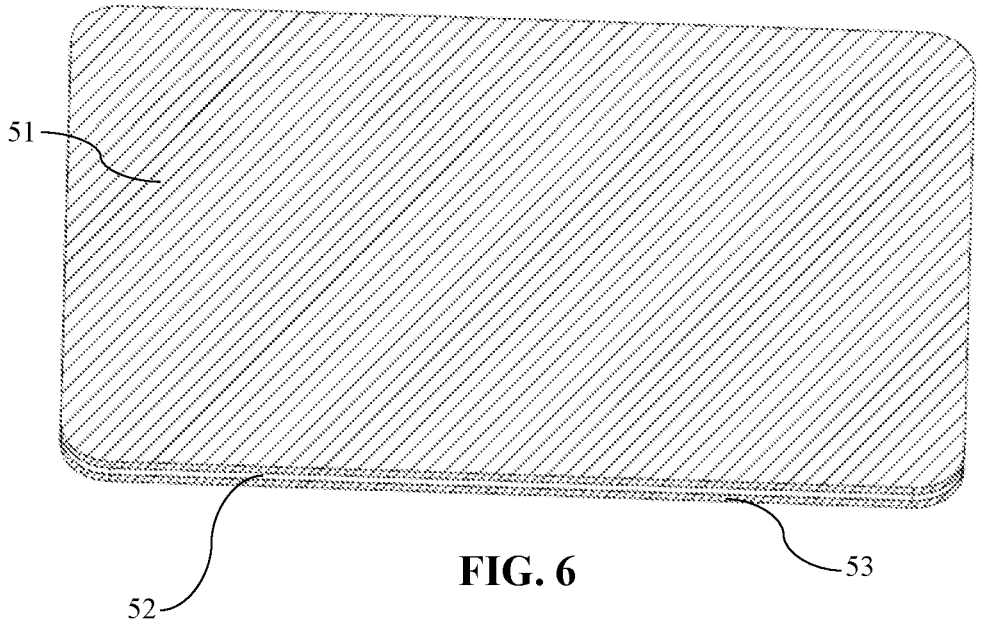
FIG. 6 depicts an alternative perspective top view of the portable support pad of FIG. 5.

FIGS. 5 and 6 illustrate an example portable support pad 500 having visually distinct layers wherein layer 51, layer 52, and layer 53 are each a unique color and/or construction to enhance various properties. The visually distinct layers are created by purposefully selecting dissimilar fibers when preparing batts during the needlefelt manufacturing process. For example, layers 51 and 53 may be black to enhance dirt concealing properties. Alternatively, layer 53 may be green to indicate a ground-contact side, while layer 52 may be a basic white construction, and layer 51 may be black. The number of layers and thickness of each layer may vary such as depending on the design of each batt, as will be apparent to those of skill in the art having the benefit of the disclosure herein.

Figure 7:
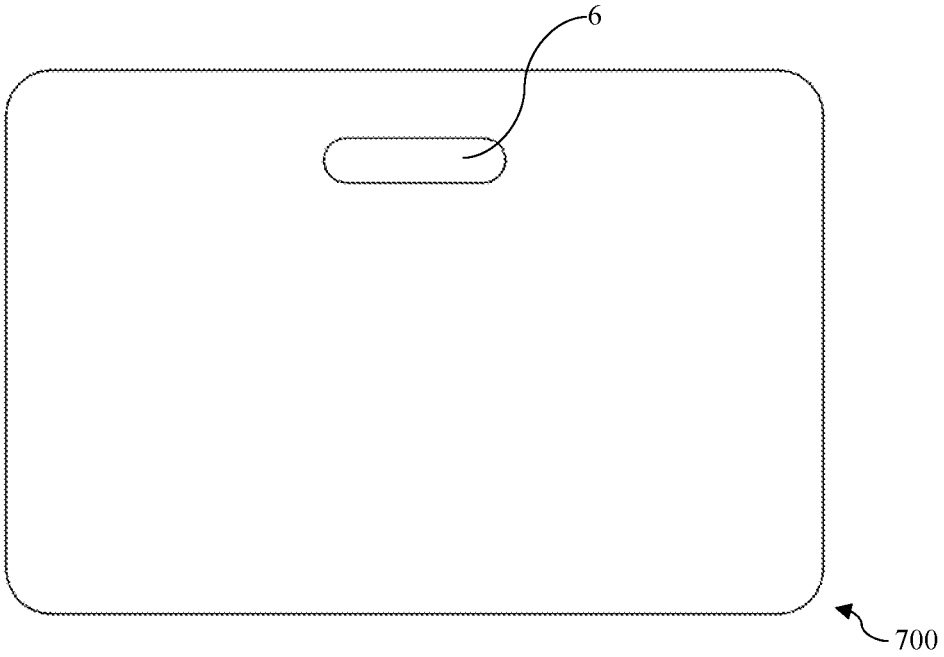
FIG. 7 depicts a top view of a portable support pad with a handle opening according to some implementations.
Figure 8:
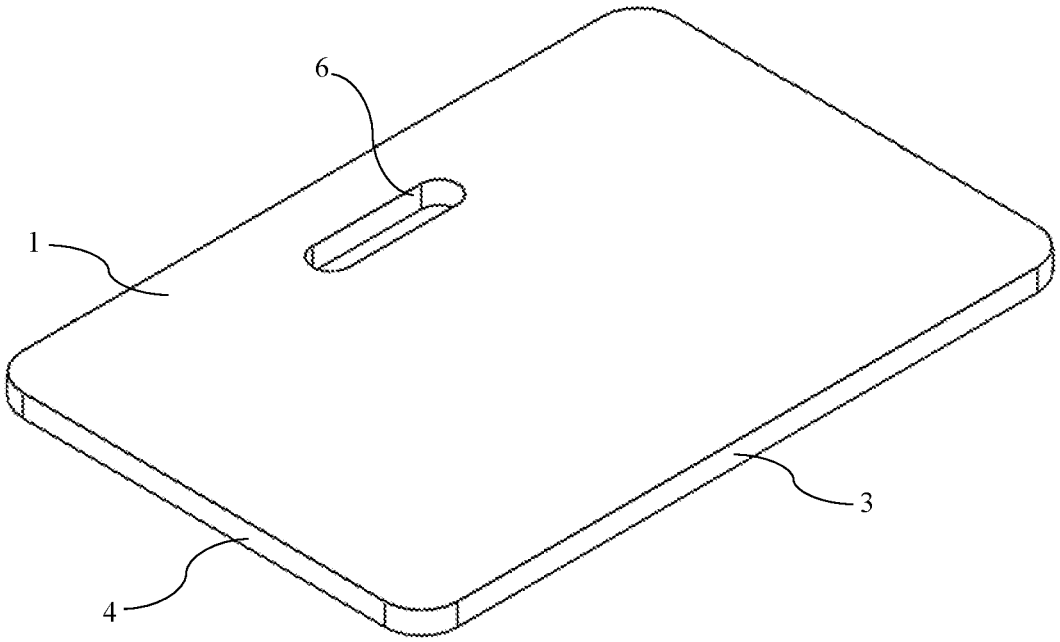
FIG. 8 depicts an isometric view of the portable support pad of FIG. 7.

FIGS. 7 and 8 illustrate an example portable support pad 700 according to some implementations. In this example, the portable support pad 700 includes an open through-slot 6 that may serve as a handle for carrying the portable support pad 700. As one example, the handle slot opening 6 may be approximately 3 inches in length with a width of approximately an inch to provide adequate space to be gripped by the hand of a user for carrying the portable support pad 700. Any of numerous variations on the shape, number, and size of openings for use as a handle will be apparent to those of skill in the art having the benefit of the disclosure herein. Additionally, in this example, the portable support pad 700 further includes a pair of opposed longer-side edge surfaces 3 and a pair of opposed shorter-side edge surfaces 4 as shown in FIG. 8.

Figure 9:
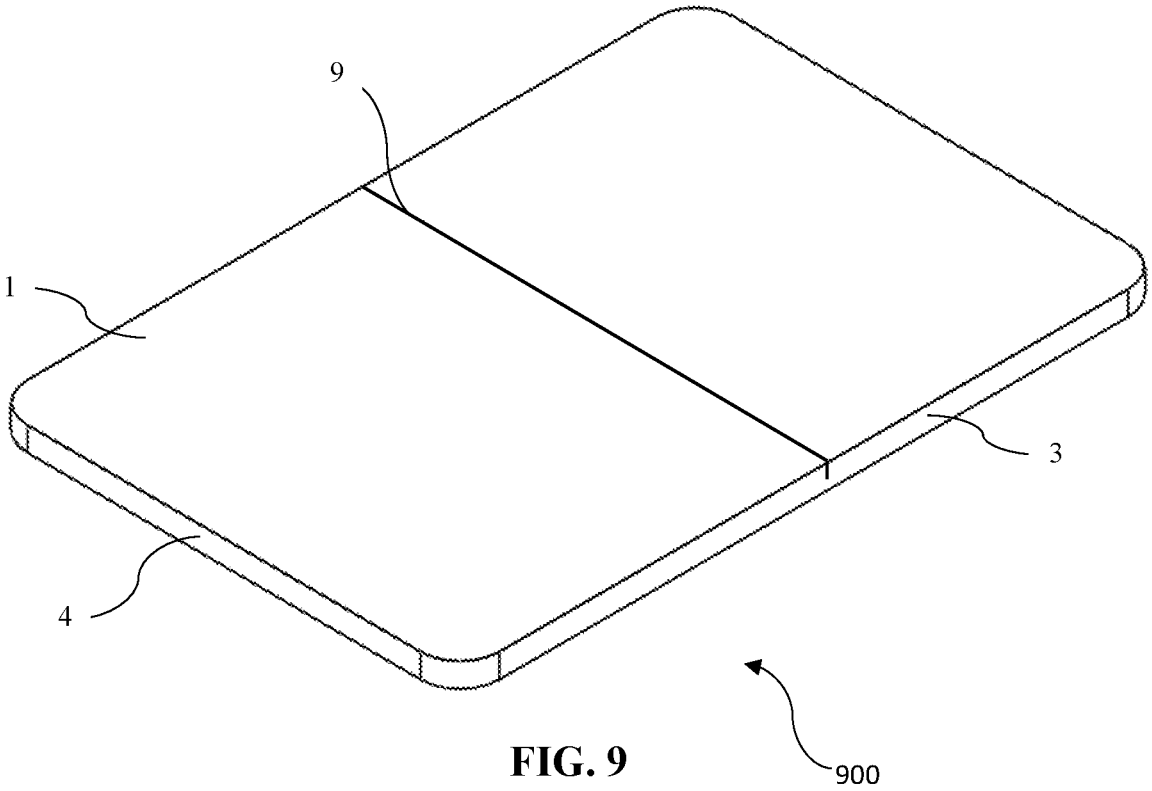
FIG. 9 depicts an isometric view of a portable support pad with a partial score-cut in the upper surface according to some implementations.

As illustrated in FIG. 9, a portable support pad 900 may intentionally include one or more partial-depth cuts 9 formed in the upper surface 1 and/or the lower surface 2 (not viewable in FIG. 9). For example, when there are more than one, the multiple partial-depth cuts 9 may be generally parallel to each other to improve foldability and portability of the portable support pad 900. For instance, the example portable support pad 900 of FIG. 9 depicts the portable support pad 900 with a partial-depth score-cut 9 that is formed in the upper surface 1 perpendicular to a pair of opposed longer-side edge surfaces 3, and parallel to a pair of opposed shorter-side edge surfaces 4 of the portable support pad 900. Accordingly, the portable support pad 900 may be folded more easily at the score line 9 than might be the case if the score line 9 was not present. The partial-depth cuts may be created mechanically, for example with a blade, or with thermal energy, for example using ultrasonic cutting or a heated wire. Numerous variations will be apparent to those of skill in the art having the benefit of the disclosure herein.

Figure 10:
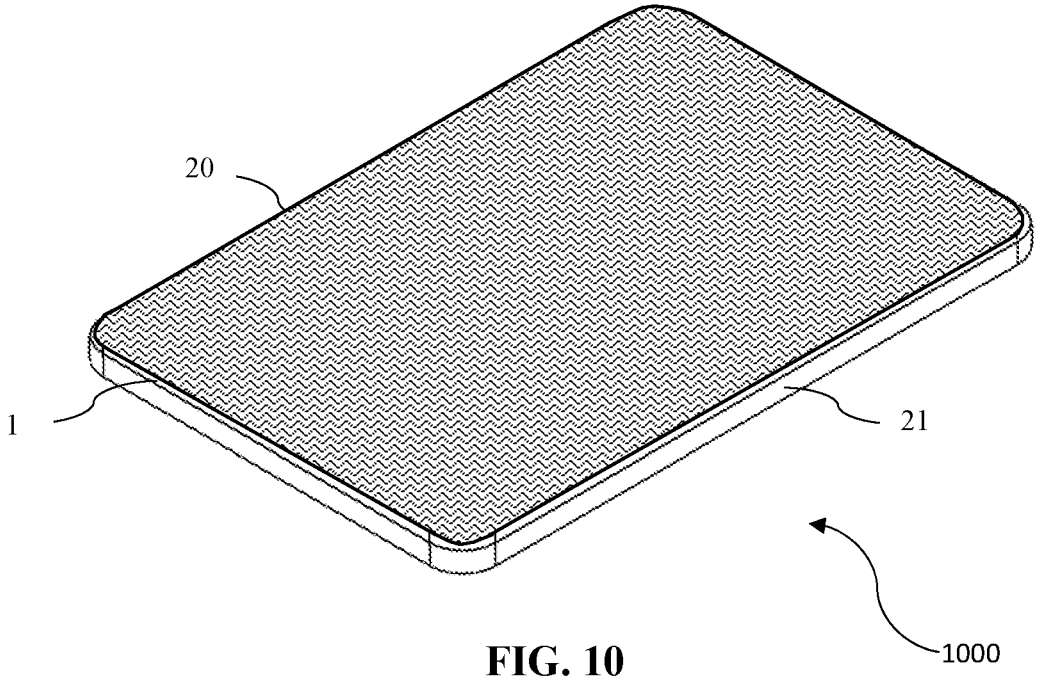
FIG. 10 depicts an isometric view of a portable support pad with a film of some thickness laminated to the upper surface according to some implementations.

FIG. 10 illustrates another example 1000 of a portable support pad comprised of a needlefelt material 21 having a film 20 laminated to at least the upper working surface 1. A thickness of the film 20 may be generally between 0.01 and 0.50 mm thick and the film 20 may serve as an impermeable fluid barrier. The film 20 is of the same geometry as the upper or lower working surfaces of the portable support pad 1000 and, in this example, is generally a rectangular shape with rounded corners. The film 20 may be transparent to opaque and a variety of colors. Further, in some cases, the working surface 2 (not visible in FIG. 10) does not have the film 20 bonded thereto, and instead may have one of the other surface treatments discussed above applied to it. Additionally, in other examples, the film 20 may be laminated on both the upper and lower working surfaces. In some examples, the film 20 may be a polyester film. Furthermore, while polyester is provided as an example of a type of film 20 that may be employed, other types of films that may be laminated to the upper and/or lower working surfaces will be apparent to those of skill in the art having the benefit of the disclosure herein. Accordingly, implementations herein are not limited to polyester as the substance for forming the film 20.

In some examples, the portable support pads 100, 500, 700, 900, 1000 and the other example portable support pads described herein may be configured to have a size that, when viewed in plan, is in a range of 12 to 22 inches in width, 8 to 15 inches in length, and a thickness of 0.5 to 2.0 inches. Additionally, the size of the portable support pads herein may vary in dimensions for differing applications or use cases, including larger sizes, such as in the range of 12 to 22 inches in width, 15 to 420 inches in length, and 0.2 to 2.0 inches in thickness. Smaller and larger configurations of the portable support pads herein will be apparent to those of skill in the art having the benefit of the disclosure herein.

Figure 11:
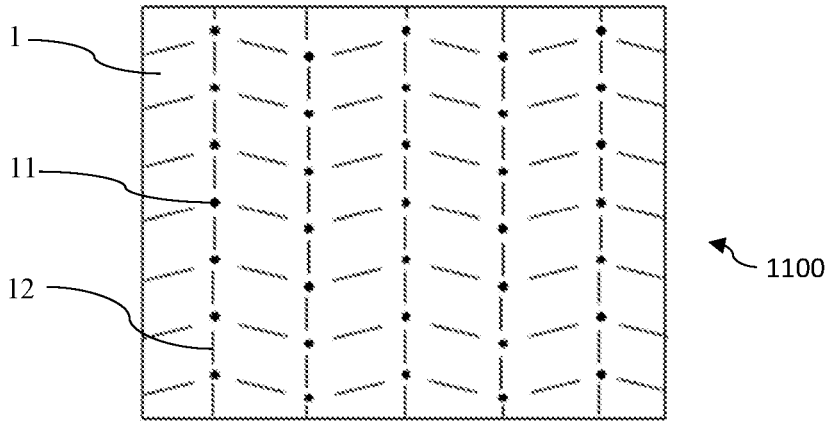
FIG. 11 depicts a view of an unfinished surface texture of a portable support pad according to some implementations.

In some examples, the portable support pads 100, 500, 700, 900, 1000 and the other example portable support pads described herein may be configured to have the texture of the upper surface 1, the lower surface 2, and the perimeter of the portable support pad be loom-state (i.e., unfinished), singed, or glazed or any combination thereof, depending on the finishing process and desired properties. FIG. 11 illustrates an example loom-state material of the upper surface 1 of a portable support pad 1100. The lower surface 2 may have a similar configuration in the loom state. For example, in FIG. 11 a plurality of small circular dots 11 represent the needle punch holes visible to the human eye from the fabrication of the polyester needlefelt material used in examples herein. Additionally, in FIG. 11, a plurality of straight lines 12 represent the orientation of the material as the material was manufactured by needle punch. Items 11 and 12 are resultants of the loom-state polyester needlefelt manufacturing process.

Figure 12:
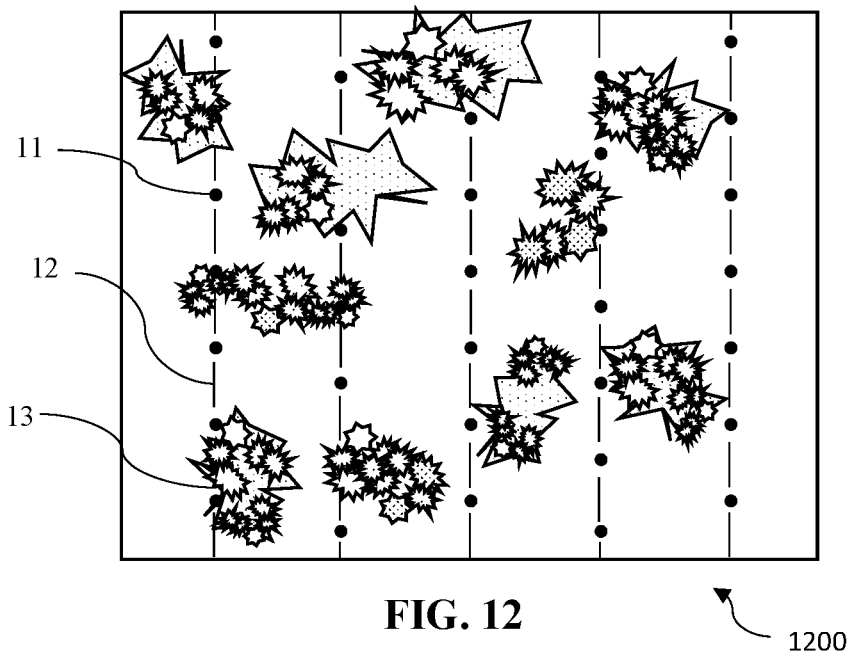
FIG. 12 depicts a view of a grit-like or singed surface texture of a portable support pad according to some implementations.

FIG. 12 illustrates another example 1200 of an upper or lower surface of the polyester needlefelt material used in the portable support pads according to some implementations. In this example, a plurality of small circular dots 11 and a plurality of straight lines 12 remain present and represent the needle punch loom-state material. However, during a secondary process, the outermost fibers near surfaces or fibers slightly protruding off surfaces may be singed from heat applied at a distance. For instance, areas 13 may have a gritty texture to the touch and may create a greater coefficient of friction between the textured surface and the user's resting point. Item 13 is the resultant of a singed finish.

Figure 13:
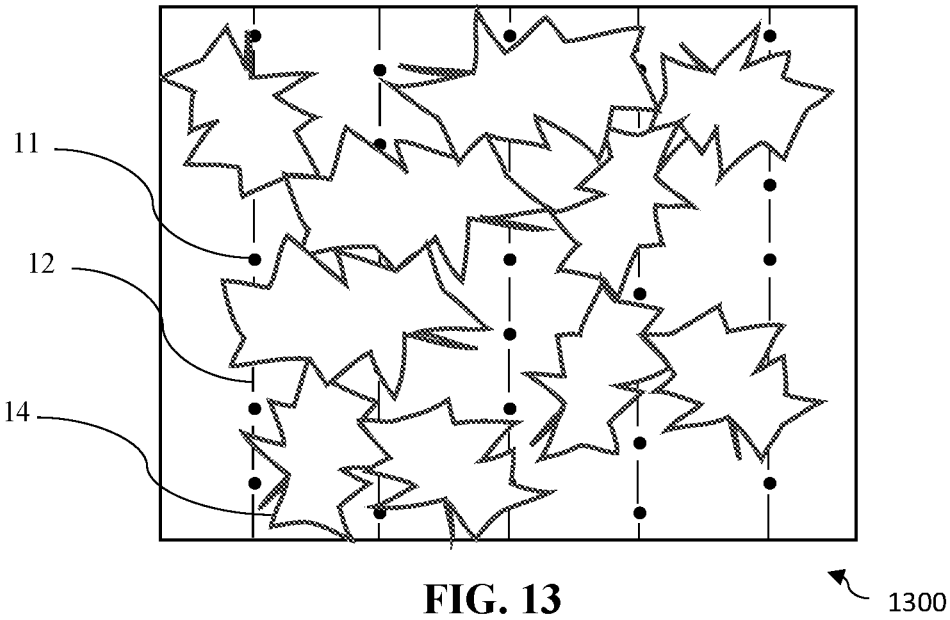
FIG. 13 depicts a view of a smoothed or glazed surface texture of a portable support pad according to some implementations.

FIG. 13 illustrates another example 1300 of an upper or lower surface of the polyester needlefelt material used in the portable support pads according to some implementations. In this example, a plurality of small circular dots 11 and a plurality of straight lines 12 remain present and represent the needle punch loom-state material. However, during a secondary process a flattened glaze texture is created in areas 14 that is a resultant of a heated and pressured rolling of the surface that occurs during a glaze finishing process. The glaze finish provides a smooth planar surface with an aesthetic shine that is less permeable by liquid/substances than a loom-state or singed surface. The singed finish of FIG. 12 offers a more slip resistant surface with a heightened coefficient of friction and the glazed finish of FIG. 13 provides a surface that is more slick and less permeable by fluid. FIGS. 11 to 13 provide a basic visual representation of the described textures and are not indicative of the exact look and properties of the material.

Figure 14:
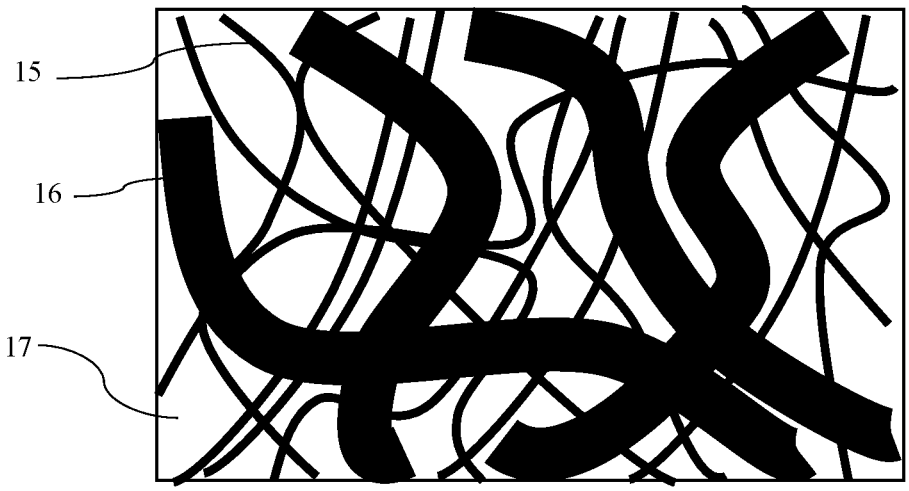
FIG. 14 depicts a magnified view of an example of polyester needlefelt material structure of a kneeling support pad according to some implementations.

FIG. 14 illustrates a magnified view of the fibers comprising the needlefelt material of the portable support pad according to some implementations. In this example, different fiber deniers 15 and 16 are surrounded by void air space 17. In some examples, the material of the portable support pads herein is nonwoven needlefelt, in particular polyester nonwoven needlefelt. Nonwoven materials are comprised of fibers or filaments which are entangled mechanically or chemically in a controlled yet randomized orientation. Nonwoven materials are unlike woven or knitted materials in that the quantity and orientation of fibers and or yarns is not strictly defined. Nonwoven needlefelt is composed of individual fibers of finite length ("staple fibers") which are blended and prepared for consolidation by processing through a "card" machine which orientates the fibers into a lightweight "web". The "web" is then festooned into a multiple layer batt and then consolidated in a "needleloom" where thousands of barbed needles "needle punch" and entangle the fibers. Considering the specific needleloom equipment being used for manufacture and including the target nonwoven area weight and target thickness may require multiple batt consolidation to achieve the target results. The polyester needlefelt in some examples, may be comprised solely of polyester fibers of varying length and denier although other examples may incorporate other types of fibers or fiber chemistry.

Figure 15:
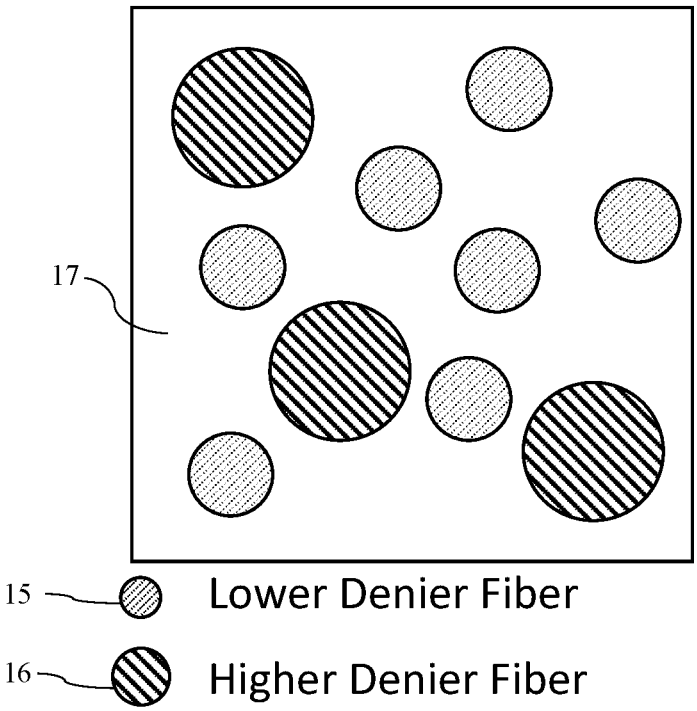
FIG. 15 depicts a magnified view of an example cross-section view of fibers of a polyester needlefelt composition of a portable support pad according to some implementations.
Figure 16:
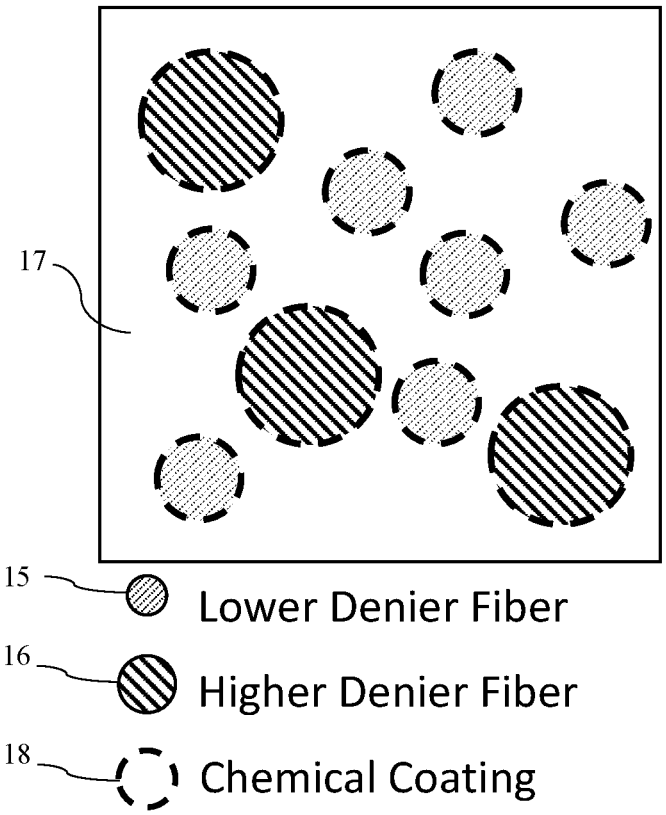
FIG. 16 depicts a magnified view of an example cross-section view of chemically coated fibers of a polyester needlefelt composition of a portable support pad according to some implementations.

As illustrated in FIG. 15, an optimal needlefelt material according to some examples herein may contain 50% to 100% 1.0 denier to 6.0 denier polyester fiber as a lower denier fiber (Item 15 in FIGS. 14-16) and 0% to 50% 3.0 to 15.0 denier polyester fiber as a higher denier fiber (Item 16 in FIGS. 14-16). Additionally, in some examples, the needlefelt material herein may include 70-80% lower denier fibers of 2-3 denier and 20-30% higher denier fibers of 4-8 denier. Furthermore, the density of the resulting needlefelt material, that is the mass per unit volume, of the example herein may be within a range from 0.08 grams per cubic centimeter (g/cc) to 0.40 g/cc. Even further, in some examples, the needlefelt material herein may have a range of 85% to 95% porosity (ratio of air void 17 volume to total volume) within the needlefelt, which may provide optimal cushioning, flexibility, fluid absorption, and durability. Variations on thickness, basis weight, fiber denier and percent composition will affect density and porosity. Porosity can be described using the formula:

$$\text{Porosity}\,(\%) = 1 - (\text{Density of the Nonwoven})/\text{Density of the Fiber})$$

The aforementioned fiber composition, ratio, and density are engineered to provide a capillary force and void volume associated with optimal material capabilities according to the implementations herein. Void volume can be described using the formulas:

$$\text{Void Volume} = (\text{Total Nonwoven Volume}) - (\text{Total Volume of Fiber})$$

$$\text{Total Nonwoven Volume} = (\text{Nonwoven Area}) \cdot (\text{Nonwoven Thickness})$$

$$\text{Total Volume of Fibers} = (\text{Total Fiber Mass})/(\text{Density of Fiber})$$

For example, pore size may be inversely related to the nonwoven's capillary force in which the smaller the pore, the higher the capillary force or the stronger the draw of liquid into the material. Fiber size may also be directly related to void volume, and nonwoven density may be inversely related to void volume, in which larger fibers and lower density are associated with higher void volume (which determines how much liquid a textile can absorb or hold). Increasing the capillary force by decreasing the pore size of the material herein yields increased absorptive capabilities, which are limited by the amount of liquid that the material is able to contain in its void volume. Because decreasing pore size increases density, it also indirectly decreases void volume. In this sense, the capillary force and void volume have a slight inverse correlation and must be balanced according to the implementations herein to obtain optimal absorption properties while also taking into consideration the other desired properties of the portable support pads herein. To offer superior absorption capabilities, the needlefelt material herein, in the ranges discussed above, is engineered with a denier composition that balances pore size with density to achieve an optimal capillary force and void volume while also maintaining cushioning, flexibility and durability. Greater void volume and greater pore size may result in higher cushioning, but lower durability and lower capillary force (an inability to draw liquid into the material). Inversely, smaller void volume and smaller pore size may increase capillary force and durability but may lower cushioning, reduce flexibility and limit the available volume of liquid that the material is able to absorb.

FIG. 15 illustrates an example cross-section composition of polyester needlefelt according to some implementations herein, but is not intended to preclude the implementations herein from other variations. For instance, as mentioned above, the optimal material composition herein may include different deniers of polyester fibers or may be specified in different percentages of composition thereof. The portable support pad herein may also be constructed of other synthetic or man-made fibers. Further, the nonwoven in the portable support pad herein may be a blend of polyester and other synthetic or natural fibers. Examples of other synthetic fibers include polypropylene, Nylon, Acrylic, Viscose, Aramid, and Polytetrafluoroethylene. Particular synthetic fibers may be employed to enhance hydrophobicity, hydrophilic behavior, abrasion resistance, flame and spark resistance, and chemical resistance. Natural fibers of animal or plant origin that may be included in some examples include cotton, wool, flax and cellulose. Select natural fibers may be employed to enhance biodegradability, breathability/comfort and fluid retention capacity. Even further, the fibers may be virgin, recycled, regenerated, or some combination thereof. Numerous variations will be apparent to those of skill in the art having the benefit of the disclosure herein.

FIG. 16 illustrates an example cross-section composition of polyester needlefelt wherein the fibers 15, 16, have a chemical coating present from a chemical treatment finishing step. Examples of chemical treatment finishing could include but are not limited to flame retardant (i.e., organic phosphorus-nitrogen compounds), hydrophilic coatings (i.e., oxyethylated carboxylic acid and aromatic carboxylic acid compounds), hydrophobic coatings (i.e., C6 fluorocarbon resins) and anti-static coatings (i.e., alkylamine ethoxylate). Numerous variations will be apparent to those of skill in the art having the benefit of the disclosure herein.

The portable support pads that include the polyester needlefelt according to the examples described herein have many advantages over conventional high-density foam support pads. At the structure level, the described polyester needlefelt according to the ranges discussed above is comprised of fibers that have been mechanically woven in random patterns by needle punching (such as discussed above with respect to FIGS. 11 and 14), whereas high density foams have structures typically consisting of rounded air gaps in a continuous foam medium.

Additionally, conventional support pads constructed of closed-cell high density foam typically are not able to absorb fluids and may degrade or may even become slippery or dangerous to use after exposed to a fluid spill. On the other hand, the polyester needlefelt support pads according to the implementations herein are more porous and have greater void volume than high density foam, making the polyester needlefelt material more absorptive yet breathable. These features allow the polyester needlefelt herein to be easily laundered using typical laundromat and household clothes washing and drying machines. The portable support pad described herein is therefore able to be easily laundered or otherwise revitalized for extended product life and use, while also providing a high degree of breathability.

Further, the portable support pad herein typically have better chemical resistance to corrosive substances (due to in part to the polyester material composition) than existing solutions, making the portable support pads according to the implementations herein more suitable for support when a user is near corrosive substances, such as in industrial or automotive contexts. Additionally, the portable support pads according to the implementations herein are more durable (resistant to tear/shear, better in tension) and more flexible (e.g., offering a drape to the pad, rather than a stiff structure) than conventional solutions, thus making the portable support pads herein better suited for use on non-flat or uneven surfaces. For example, the portable support pads herein may be easily coiled or folded for improved portability as compared to many conventional foam constructions and are of lighter weight. These features provide an advantage for users who travel to various work sites, events, or the like. Consequently, the portable support pads according to the implementations herein address outstanding issues with portable support pads that are lacking in conventional pads.

The foregoing is merely illustrative of the principles of this disclosure and various modifications can be made by those skilled in the art without departing from the scope of this disclosure. The above described examples are presented for purposes of illustration and not of limitation. The present disclosure also can take many forms other than those explicitly described herein. Accordingly, it is emphasized that this disclosure is not limited to the explicitly disclosed methods, systems, and apparatuses, but is intended to include variations to and modifications thereof, which are within the spirit of the following claims.

As a further example, variations of apparatus or process limitations (e.g., dimensions, configurations, components, process step order, etc.) can be made to further optimize the provided structures, devices and methods, as shown and described herein. In any event, the structures and devices, as well as the associated methods, described herein have many applications. Therefore, the disclosed subject matter should not be limited to any single example described herein, but rather should be construed in breadth and scope in accordance with the appended claims.

Additionally, although the subject matter has been described in language specific to structural features and/or methodological acts, it is to be understood that the subject matter defined in the appended claims is not necessarily limited to the specific features or acts described. Rather, the specific features and acts are disclosed as example forms of implementing the claims.

What is claimed is:

1. A portable support pad for reducing physical stress and/or fatigue associated with kneeling, sitting, lying, and/or standing on rigid, flat, irregular and/or un-even surfaces, the portable support pad constructed of nonwoven needlefelt that is flexible, porous, absorptive, and chemically resistant to corrosive substances, wherein the portable support pad constructed of the nonwoven needlefelt comprises a plurality of individual fibers of finite length having been oriented into a web, festooned into a multilayer batt, and consolidated into a pad configuration using a plurality of barbed needles to entangle the individual fibers of the batt with others of the individual fibers of the batt, wherein the individual fibers include synthetic fibers, natural fibers, or a combination thereof, and wherein the individual fibers are between 50% to 100% 1.0 denier to 6.0 denier fiber as a lower denier fiber, and 0% to 50% 3.0 denier to 15.0 denier fiber as a higher denier fiber.

2. The portable support pad of claim 1, wherein the portable support pad is machine washable and dryable.

3. The portable support pad of claim 1, wherein the portable support pad includes a generally planar upper surface and a generally planar lower surface, wherein the upper and lower surfaces are loom-state.

4. The portable support pad of claim 1, wherein the portable support pad includes a generally planar upper surface and a generally planar lower surface, wherein at least one of the upper surface, or the lower surface is singe finished to provide a textured, more slip-resistant plane.

5. The portable support pad of claim 1, wherein the portable support pad includes a generally planar upper surface and a generally planar lower surface, wherein at least one of the upper surface or the lower surface is glaze finished to provide a less fluid permeable and more aesthetic plane.

6. The portable support pad of claim 1, wherein the nonwoven needlefelt is constructed of polyester fibers.

7. The portable support pad of claim 1, wherein the nonwoven needlefelt is constructed of polyester fiber with a density range from 0.08 g/cc to 0.40 g/cc and a porosity range of 85% to 95%.

8. The portable support pad of claim 7, wherein the portable support pad is rectangular in shape and sized in a range of 12 to 22 inches in width, 8 to 15 inches in length, and 0.5 to 2.0 inches in thickness.

9. The portable support pad of claim 7, wherein the portable support pad is rectangular in shape and sized in a range of 12 to 22 inches in width, 15 to 420 inches in length, and 0.2 to 2.0 inches in thickness.

10. The portable support pad of claim 7, wherein the portable support pad is non-rectangular in shape and 0.5 to 2.0 inches in thickness.

11. The portable support pad of claim 8, wherein the nonwoven needlefelt includes a handle shaped opening.

12. The portable support pad of claim 8, wherein the portable support pad is score-cut on at least one surface to enable folding.

13. The portable support pad of claim 8, wherein a polyester film is laminated to at least a top surface or a bottom surface of the portable support pad to create a fluid impermeable barrier.

14. The portable support pad of claim 8, wherein the nonwoven needlefelt is a polyester needlefelt that is chemically treated to enhance at least one of flame resistance, fluid absorption or electrostatic properties of the nonwoven needlefelt.

15. A portable support pad constructed of nonwoven needlefelt material that includes between 50% to 100% 1.0 denier to 6.0 denier fiber as a lower denier fiber, and 0% to 50% 3.0 denier to 15.0 denier fiber as a higher denier fiber, wherein the portable support pad constructed of the nonwoven needlefelt material comprises a plurality of individual fibers of finite length having been oriented into a web, festooned into a multilayer batt, and consolidated into a pad configuration using a plurality of barbed needles to entangle the individual fibers of the batt with others of the individual fibers of the batt, wherein the individual fibers include synthetic fibers, natural fibers, or a combination thereof.

16. The portable support pad of claim 15, wherein the nonwoven needlefelt material includes 70-80 percent lower denier fibers of 2 denier to 3 denier and 20-30 percent higher denier fibers of 4 denier to 8 denier.

17. The portable support pad of claim 15, wherein a density of the nonwoven needlefelt material is within a range from 0.08 g/cc to 0.40 g/cc.

18. The portable support pad of claim 15, wherein the nonwoven needlefelt material has a porosity between 85 to 95 percent.

19. The portable support pad of claim 15, wherein at least one of the lower denier fibers or the higher denier fibers are polyester fibers.

* * * * *